United States Patent [19]

Delery

[11] 4,196,530

[45] Apr. 8, 1980

[54] SKI BOOT

[75] Inventor: Marc Delery, Caluire, France

[73] Assignee: Trappeur, Saint-Laurent du Pont, France

[21] Appl. No.: 957,334

[22] Filed: Nov. 3, 1978

[30] Foreign Application Priority Data

Nov. 4, 1977 [FR] France ..... 77 33834

[51] Int. Cl.[2] ..... A43B 5/04

[52] U.S. Cl. ..... 36/119

[58] Field of Search ..... 36/117, 119, 50, 105

[56] References Cited

U.S. PATENT DOCUMENTS 3,828,448 8/1974 Leonildo ..... 36/119

FOREIGN PATENT DOCUMENTS 2712001 9/1977 Fed. Rep. of Germany ..... 36/119

*Primary Examiner*—Patrick D. Lawson

*Attorney, Agent, or Firm*—Stevens, Davis, Miller & Mosher

[57] ABSTRACT

A plastic ski boot, comprising a molded shell formed of one solid stock with the sole, an upper insole rigidly situated at the bottom of the shell and above the sole, flexible tightening means taking support on the different faces of the shell, intended to firmly tighten the shell to the foot of a skier, wherein at the level of the heel, at the interior of the space formed between the upper insole and the sole, a rigid member connected to the end of the tightening means which, when it is subjected to a pressure exercised on the rear of the boot by the boltlocking of the rear abutment of the connection of the binding to the boot, exerts on said tightening means a force assuring holding of the foot in the interior of the boot.

14 Claims, 14 Drawing Figures

120
137
136
135
8
137
121
123
122
124
3
130
5
133
132
131
126
134
129
128
127
126
125
4

SKI BOOT

The invention concerns a new plastic ski boot of the type comprising a rigid shell molded, particularly by injection, formed of a solid stock with a sole, and a rigid upper insole intended to be applied to the rear of the shell on the face of the interior of the sole.

It has long been known to manufacture ski boots by the injection of different plastic materials, such as notably those of polyethylene, polypropylene, polyurethane elastomer, ABS (terpolymer of acrylonitrile-butadienestyrene), PVC (polyvinyl chloride) or polyamide (type 6 or type 11) in a mold of appropriate form. These boots despite their extensive developement, nevertheless present certain inconveniences, notably for the user.

Several years ago there were proposed molded ski boots wherein the foot is engaged in the boot at the rear (see notably Ski Flash Magazine, No. 17, Nov. 1975, pp. 51 et seq). To use such boots, the skier rocks or overbalances toward the rear of the boot to open same, places hit foot into the boot, lowering the rear cover and finally pressing his foot and simultaneously closing the boot with the aid of classic tightening means such as clasps, cables, or levers disposed for that purpose in appropriate locations.

This boot with opening from the rear still presents certain disadvantages. First, the operation of closing necessitated a certain force and is not convenient to execute with gloves and in the cold. Next, during falling, although the fixation jaw whose role in opening, together with the foot and tibia rests firmly to constrain the boot, such that certain lag effects sometimes aggravate fractures. Finally, during these efforts to make an elastic guard (an elastic course) of the rear fixation (generally on the order of about six millimeters), the boot and thus the leg, are constantly subjected to the forces of variable binding, and not elastic. This is very unfavorable for the circulation of the blood of the skier, of which there is practically no redemption in the pressure zones.

The present invention overcomes these disadvantages. It concerns a perfected plastic ski boot, comprising: a molded shell formed as a solid stock with the sole, a rigid upper insole intended to be applied to the rear of the shell above the sole, and flexible tightening means for applying pressure to the different faces of the shell, intended to firmly bind the shell onto the foot of a skier.

This new boot is characterized in that there is present at the level of the heel in the interior of the space formed between the upper and the sole, a rigid member connected to the extremity of the flexible binding means which, when it is under a pressure caused by locking of the bindings of the boot onto the ski, experts upon said tightening means a force assuring holding the foot in the interior of the boot.

Advantageously, the rigid member is capable of being moved about an horizontal axis perpendicular to a longitudinal plane of the boot and at least one of the ends of the flexible binding means is attached to the rigid member at one of the lateral ends of the latter.

In practice, the rigid member is capable of being pivoted about a fixed horizontal axis.

Preferably, the pivoting rigid member is formed of two branches directed toward the bottom of the sole, thus the horizontal pivot axis is situated at the junction point of the two branches and thus the branch directed toward the front of the boot receives the end of the flexible binding means.

In this embodiment the sole includes a hole situated at the level of the heel, through which extends the free end of the branch of the movable member directed toward the rear of the boot, at least when the pivotal member is at rest, which is when the flexible binding means is not tensioned.

In an improved form, the rigid pivotal member includes a third branch directed toward the rear of the boot and toward the lower face of the upper insole, understandably as the extension of the branch directed toward the front, the upper face of said third branch applying pressure to the lower face of the upper during pivoting movement of the rigid member.

In another embodiment, the boot additionally includes a movable piece also located in the space formed between the upper and the sole, behind the pivotal rigid member and thus the height of which is slightly above that of that space, said movable piece being adapted to slide vertically in a hole arranged for that purpose in the heel of the sole, to apply pressure upward under the lower surface of the upper insole.

Advantageously, the free extremity of the branch of the rigid pivotal member, directed toward the rear and the base of the sole is engaged through a hole made for that purpose by said moveable sliding piece. Additionally, that hole takes the place of elements intended to assure fluid tightness.

In order to prevent snow, water or other elements from penetrating the boot by entering the open hole, which provides in lieu of another element, fluid tightness, this one also includes, for example a seal located at its entrance between it and the branch of the movable member.

In another improved embodiment, the boot includes another movable piece also located in the space formed between the upper and the sole, behind the rigid pivotal member and whose height is substantially less than that of the space, said movable piece being adapted to slide vertically in a hole arranged for that purpose in the heel of the sole for applying pressure upward under the free end of the branch of the rigid pivotal member directed toward the rear of the boot.

Likewise, this boot is able to include in addition an eccentric wedge located at the rear of the boot just under the upper insole and behind the rigid pivotal member, the axis of articulation of said wedge being parallel to the axis of rotation of the rigid pivotal member, the surface of the branch of the pivotal member located with respect to the wedge forming a cam for permitting said wedge to push the upper toward the top when pivoting the rigid member.

According to a variation, the boot includes in addition a second rigid pivotal member, also located between the upper insole and the sole, behind the first rigid pivotal member, formed of two branches and whose pivot axis is parallel to that of the first rigid pivotal member, one of the ends of the branch of the second member situated toward the rear exiting through the zone called "of pressure of the jaw of the heel of the binding" which is located to the rear of and above the sole, such that the end of the other branch of the second member presses on the lower face of the branch of the first pivotal member directed toward the rear.

Finally, according to another embodiment, the pivoted end of the rigid member which receives the end of the flexible tightening means is directed toward the rear of the boot with respect to the pivot axes, the boot includes in addition a second rigid pivotal member also located between the upper insole and the sole, behind the first pivoted member, formed of two branches articulated about an axis parallel to that of the first member whose one branch is directed toward the front of the boot and toward the top, in a curved form, such that its end extends to bring pressure to the top surface of the pivoted end of the first movable member.

Advantageously, the rear part of the shell of the boot is able to be disengaged toward the rear for introduction of the foot of the skier.

Likewise, in practice, the flexible tightening means comprises cables, for example braided metallic cable, or horesehair, even of reeds of plastic, and the shell is also constructed in plastic molded either by injection, or by blowing.

Advantageously, the movable member is of rigid plastic material, little affected by water and cold, for example of polycarbonate or polyamide.

In this description, "upper insole" designates the rigid insole located under the foot in the bottom of the boot. This is also sometimes called the "clean upper".

The manner in which the invention is able to be realized and the resultant advantages thereof will be better appreciated as a consequence of the description which supports the accompanying figures and the examples of the embodiments which are intended to be indicative and not limiting.

FIGS. 1 and 2 represent a partial longitudinal section of a boot according to the invention in the positions, respectively, in the course of closing of the binding (FIG. 1), and closed and locked (FIG. 2).

FIG. 3 also shows in partial longitudinal section a variation of the invention.

Figure 1:
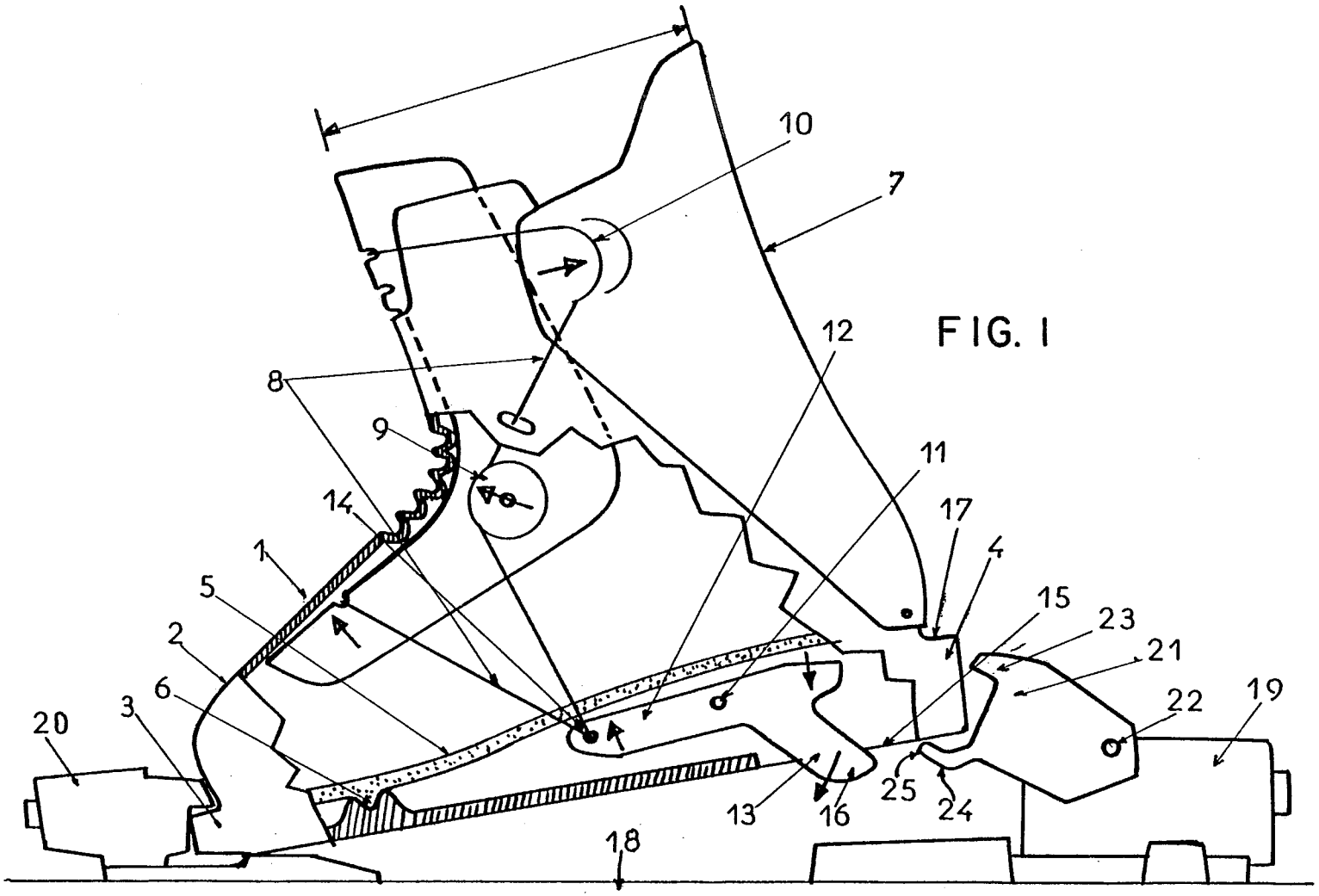
Figure 2:
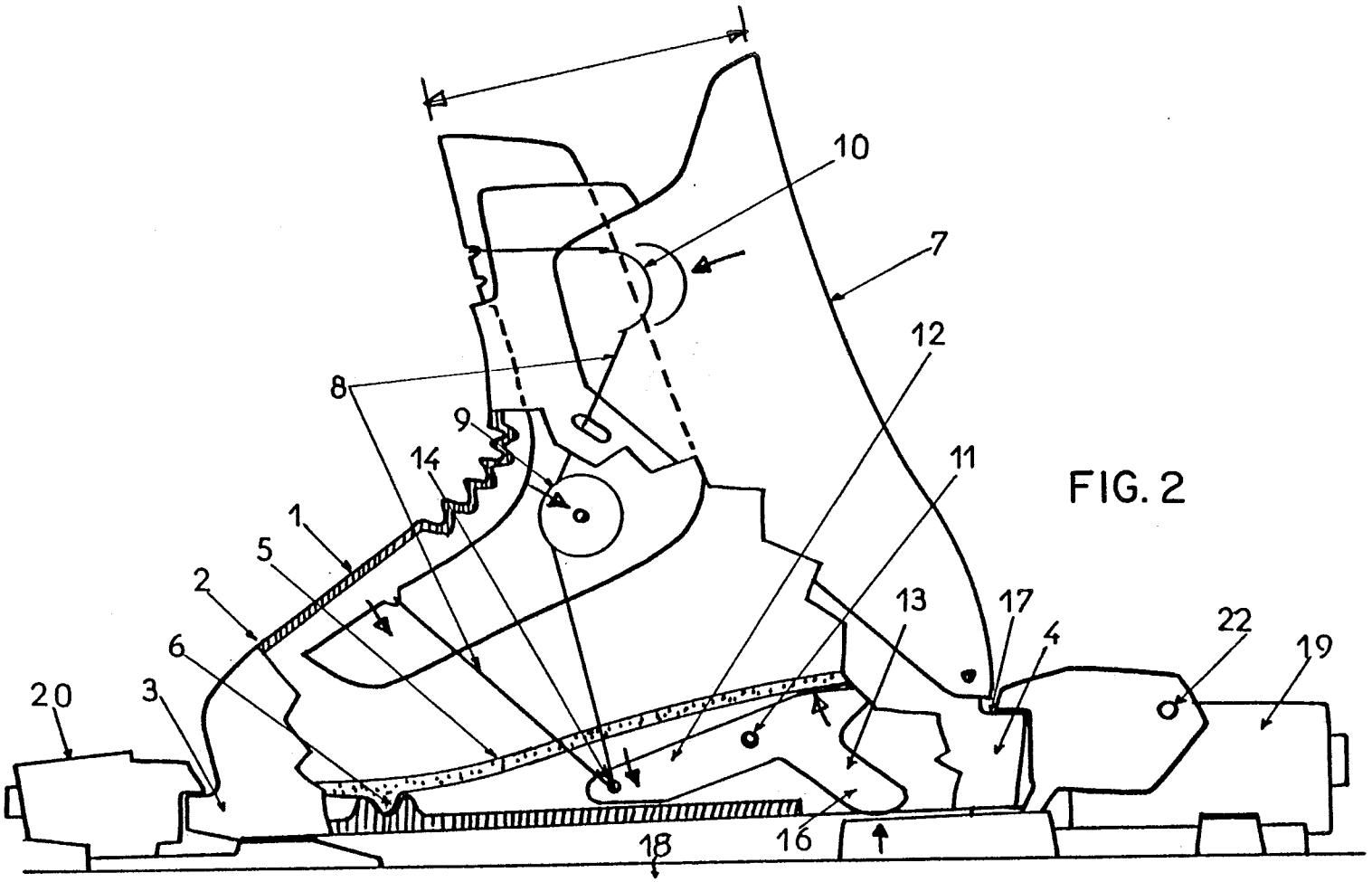

With reference to FIGS. 1 and 2, the ski boot comprises first a shell 1, rigid or semi-rigid molded by injection, for example of polyurethane, formed of a stock 2 solid with the sole 3 and its heel 4. Over the two latter elements there is located a rigid upper insole 5 intended to be applied to the base of the shell 1 over the upper surface of the sole 3 and of heel 4, taking for example pressure over the forward end 6. This upper insole 5 is for example of aluminum or of another analogous material such as wood, rigid plastic material metal, etc. placed in place after the injection operation narrowly creates the form of the interior of the boot and of the plantar arch of the foot of the lining in which is placed the leg of the skier. In a known manner, the lining is sewed or injected coated with leather or other equivalent material.

The leg of the skier is able to be enclosed in the boot in the classic manner, either for example with the aid of an injected collar, or by tilting of the rear part 7 of the boot. The boot finally comprises the flexible means for tightening such as metallic braided cables 8 taking pressure under swellings 9 and 10 integral with the stock 2 of the tilting part 7, coming directly from the molding.

In the space defined between the upper insole 5 and the base of the sole 3, is found a movable member pivoted about a fixed horizontal axis 11 perpendicular to a longitudinal plane of the boot, formed of two V-shaped rigid branches 12 and 13 toward the base on which the axis 11 is situated at their point of junction. The free end of the branch 12 directed across the front presents an axis 14 intended to receive the ends of the flexible tightening cables 8.

As seen from the figures, the cable 8 is made in the form of two cables, one intended to be tightened with a blow of the foot, the other located on the upper side to tighten the ankle. The ends of each of the cables are fixed to part of the other along a longitudinal plane of the boot at each of the ends of the horizontal axis 14.

In practice the movable member 12–13 is polycarbonate and the axes 11–14 are molded steel on the same movable member.

The sole 3 includes at the level of the heel 4 a hole 15 which extends through same and permits passage of the free end 16 of branch 12 directed toward the rear of the boot, at least when the movable member 12–13 is at rest, that is when the cables 8 are not held over the boot. Eventually, the hold 15 provides the known means intended to ensure the tightness of the assembly.

The complete equipment of a skier also comprises in the manner known: a flat pressure zone 17, a ski 18 on which is fixed the binding of which the heel piece 19 and the toe piece 20, are controlled in appropriate fashion, the jaw 21 pivoted and stoppable about the axis 22 of the heel piece, comprises a holding hook 23 intended to come into bearing engagement on the flat zone 17 and the closing pedal 24 intended to come into bearing engagement under the flat lower face 25 of heel 4.

The ski 18 also comprises classic means, not shown, such as friction pads, wedges, tiles, etc.

The insertion of the boot is effected in the following manner (Cf. FIGS. 1 and 2).

The skier places his foot into the shell 1 such that his plantar arch places pressure on the rigid upper insole 5. In this shoed position, but not locked (FIG. 1), the foot is able to be freely displaced in the boot, because it is not secured. The skier then places the boot on the binding, the boot having the end 16 of branch 13 which passes through hole 15 pressing on the ski 18, the front of the boot in the toe piece 20 and the heel 4 in the heel piece 19. The lower pressure zone 25 applies pressure to the closing pedal 24. At the time of locking of the binding, the pedal 24 descends until the lower pressure zone 25 rests on the ski 18 and the holding hook 23 of the jaw 21 is firmly pressed onto the flat pressure zone 17. During this locking movement when said boot has a tendency to press toward the base, the branch 13 has a tendency under the effect of the pressure on the ski 18 to pass through the hole 15, in order to inter the space formed between the upper insole 5 and the sole 3, that is directed upward. By pivoting around the axis 11, the other branch 12 will have a tendency to go downward and in this way to assure tightening of the cables 8 on the swellings 9, 10 and thus tightening the foot in the boot. In this way, simultaneously two very distinct functions are carried out, that is the closing-locking of the boot onto the ski, and the tightening of the foot into the boot.

In other words, the invention consists in advantageously employing the action of closing and locking the boot onto the ski to also assure tightening of the foot in the boot.

FIGS. 3 to 9 and 11 represent different embodiments of the movable tightening member.

Figure 3:
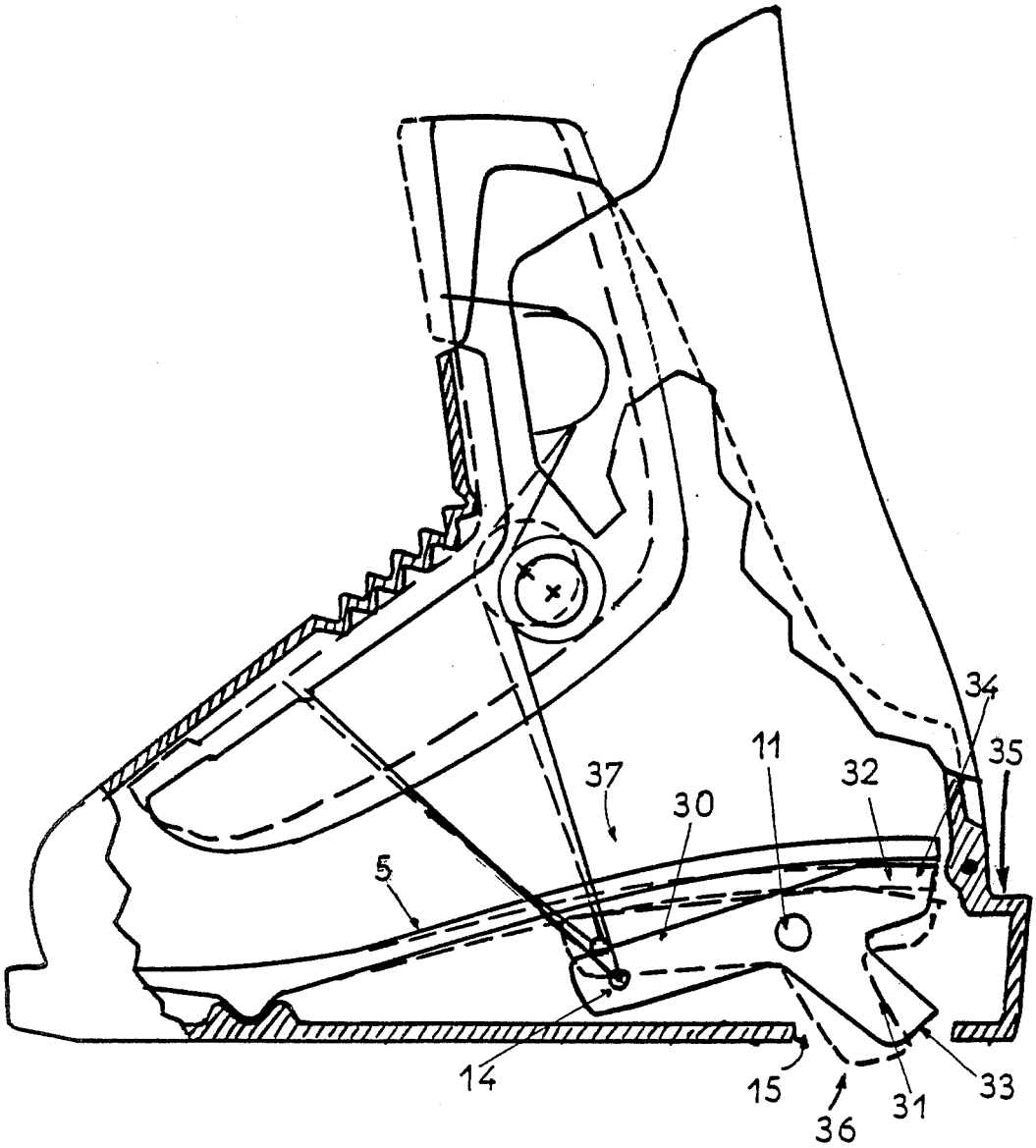

Referring to FIG. 3 that member comprises three branches, 30, 31 and 32, respectively, which together are pivotable about horizontal axis 11. The first branch 30 is directed downward and toward the front and carries at its end the horizontal axis 14. The second branch 31 is directed downward, but toward the rear of which end 33 is able to extend through hole 15 and to apply pressure to the ski 18 (not shown). The third branch 32 is located to the rear, but upward, so that the extension 30 and whose end 34 places pressure on the lower face of the upper insole 5 at the level of heel 4 during the pivotal movement of the assembly about horizontal axis 11.

Thus, at the moment of placing the boot in place, and more precisely at the moment of locking the boot into the binding, the action of jaw 21 on flat zone 17 illustrated by arrow 35, combined with the pressure from 34 onto the ski 18, exerts an action of 33 in the sense indicated by arrow 36. In this manner, branch 31 rises by pulling by rotation about 11 the descent of branch 30 in the sense indicated by arrow 37. In this way the tension on the tightening cables 8 is assured.

Simultaneously, the zone 34 of branch 32 is directed toward the top in the sense indicated by arrow 38 until it applies pressure under the upper insole 5, after which to raise same. This action simultaneously assures better tightening of the foot in the boot.

Figure 4:
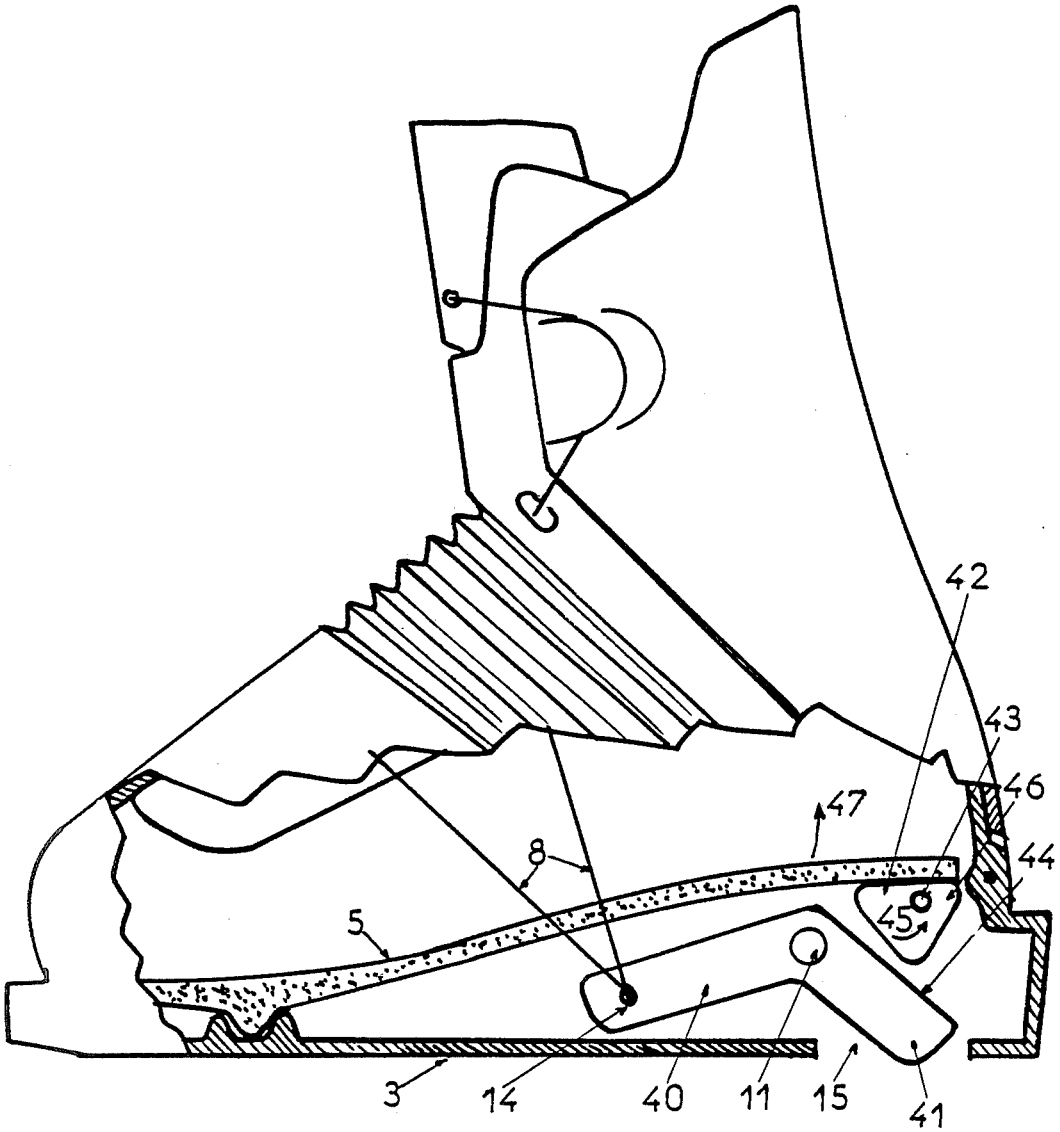
FIGS. 4–9 and 11 represent in partial longitudinal section various embodiments of the movable member.

Referring to FIG. 4, the movable member is comprised of, as in the preceding figures, two V-shaped branches 40 and 41 directed downward, pivoted exactly at their junction about horizontal axis 11, the branch directed toward the front including axis 14 for attachment of the end of the cables 8. This movable member comprises an outer eccentric wedge 42 in the form of a cam for permitting said wedge to push the upper insole 5 toward the top when member 40, 41 pivots.

As before, when it is placed in the binding, the branch 41 returns through hole 15, thus making a rotation, one part, the branch 40 toward the base thus assuring tightening tension on cables 8, and the other part, simultaneously, the rotation of the wedge 42 in the sense indicated by arrow 45, in the manner that one of the points 46 of the wedge comes progressively into pressing contact with the upper insole 5 and lifts same toward the top in the sense indicated by arrow 47 and by way of the consequence of inserting the foot into the boot and thus augmenting the tightening action.

Figure 5:
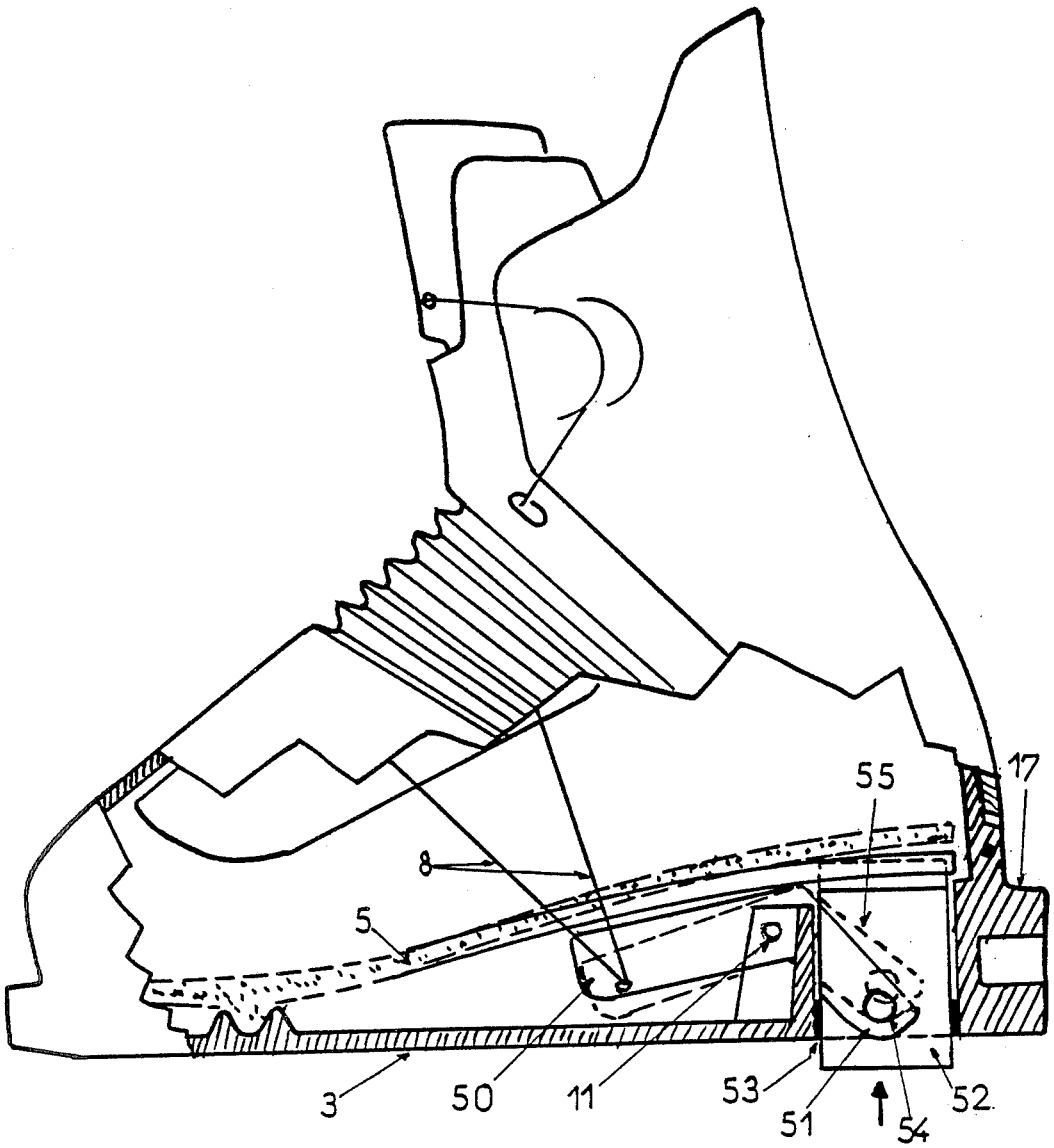
Figure 6:
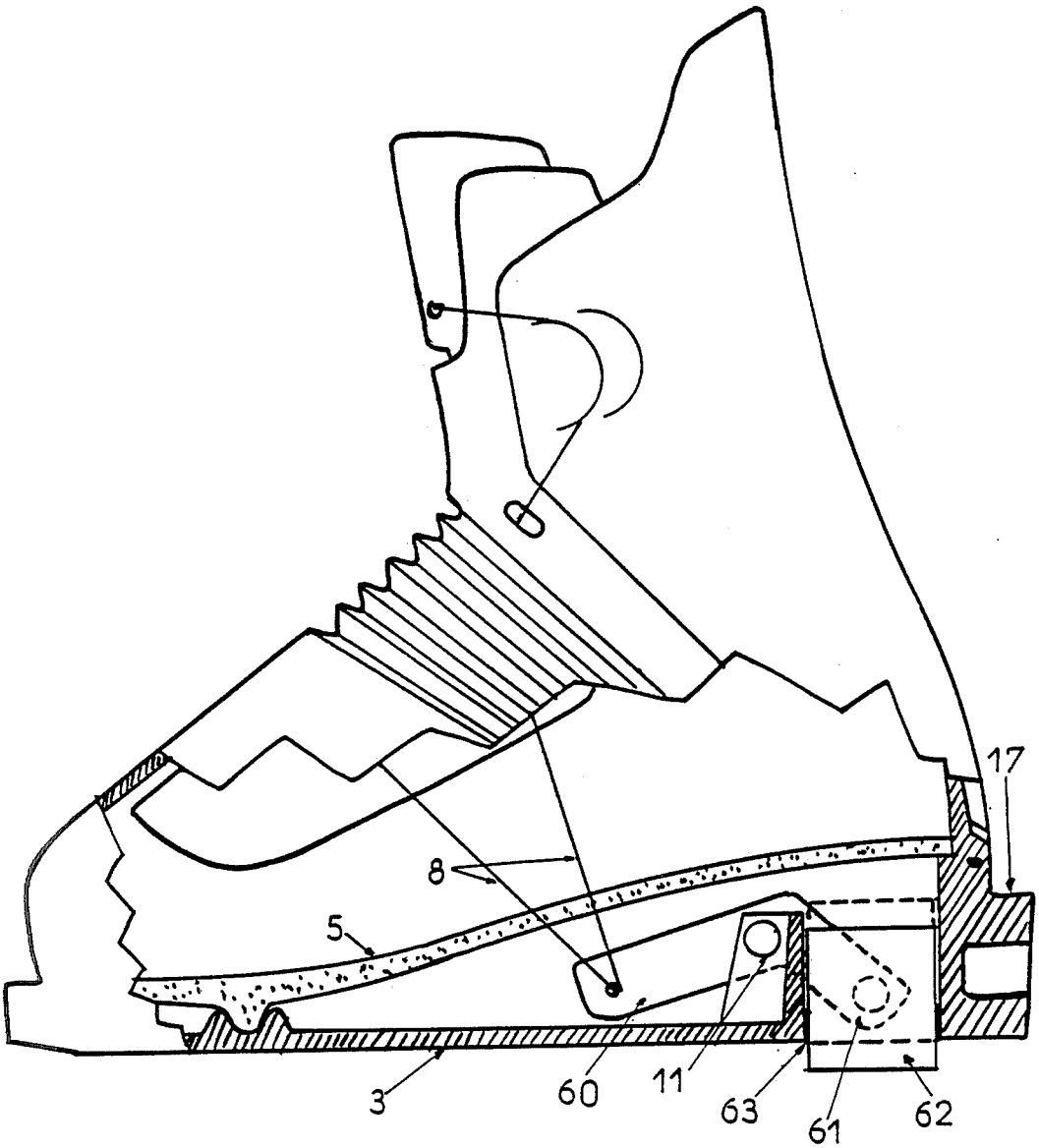

In the variations shown in FIGS. 5 and 6, the mobile member constitutes, as before, the two V-shaped branches inclined toward the rigid base, respectively 50–51 and 60–61, and a movable rigid piece 52 and 62, respectively, exiting through a hole 53, 63 through a sole 3 and carrying pressure toward the top on the underside of the upper insole 5; advantageously, this movable rigid piece 52, 62 sensibly engages all of the surface of the heel.

In the first embodiment (see FIG. 5), the end 54 of the branch 51 is lodged in a slot 55 arranged to that effect in the interior of rigid piece 52.

When one puts on boots and locks the bindings, the jaw bears upon the boot at flat zone 17 thereby pushing down piece 52 and branch 51 which is entrained in rotation about axis 11 with the branch 50 thus tightening the cables 8.

Figure 7:
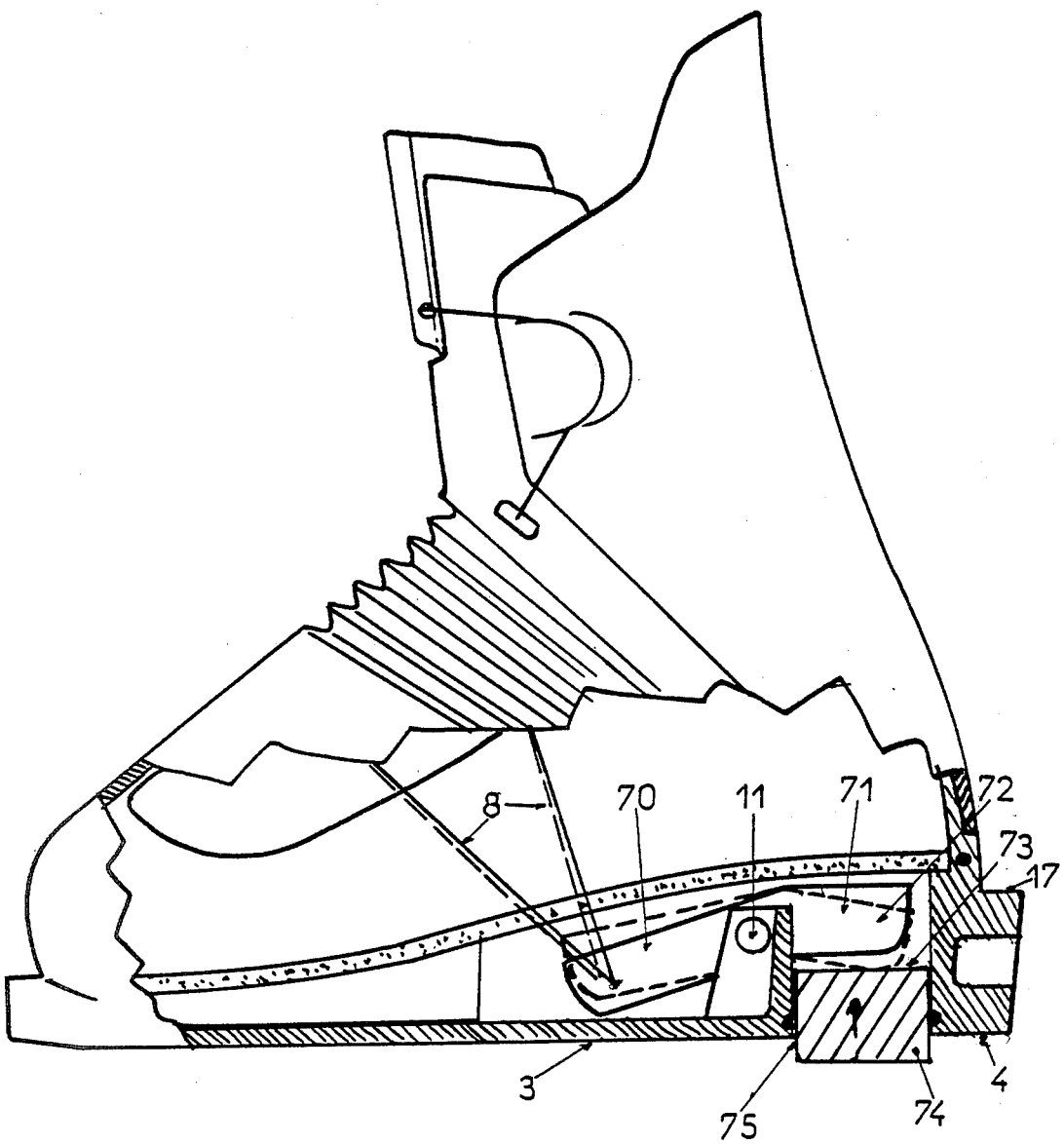

FIG. 7 shows another embodiment in which the V-shaped movable member includes, as before, two rigid but unequal branches 70 and 71. The end 72 of the branch directed toward the rear places pressure on the upper surface 73 of rigid piece 74 in a vertical plane exiting through hole 75 arranged to this effect in the sole 3 at the level of heel 4. At rest, that is when the boot is not in place on the ski, piece 74 exits through the sole 3. When one places the boot in place on the ski, under the action of the jaw at the rear of the binding which bears upon flat 17, piece 74 ascends in the sense indicated by the arrow until it comes under the influence of sole 3. Under the effect of the displacement, the branch 71 pivots upward about axis 11, which causes displacement of branch 70 downward and in this way the tightening of cables 8.

Figure 8:
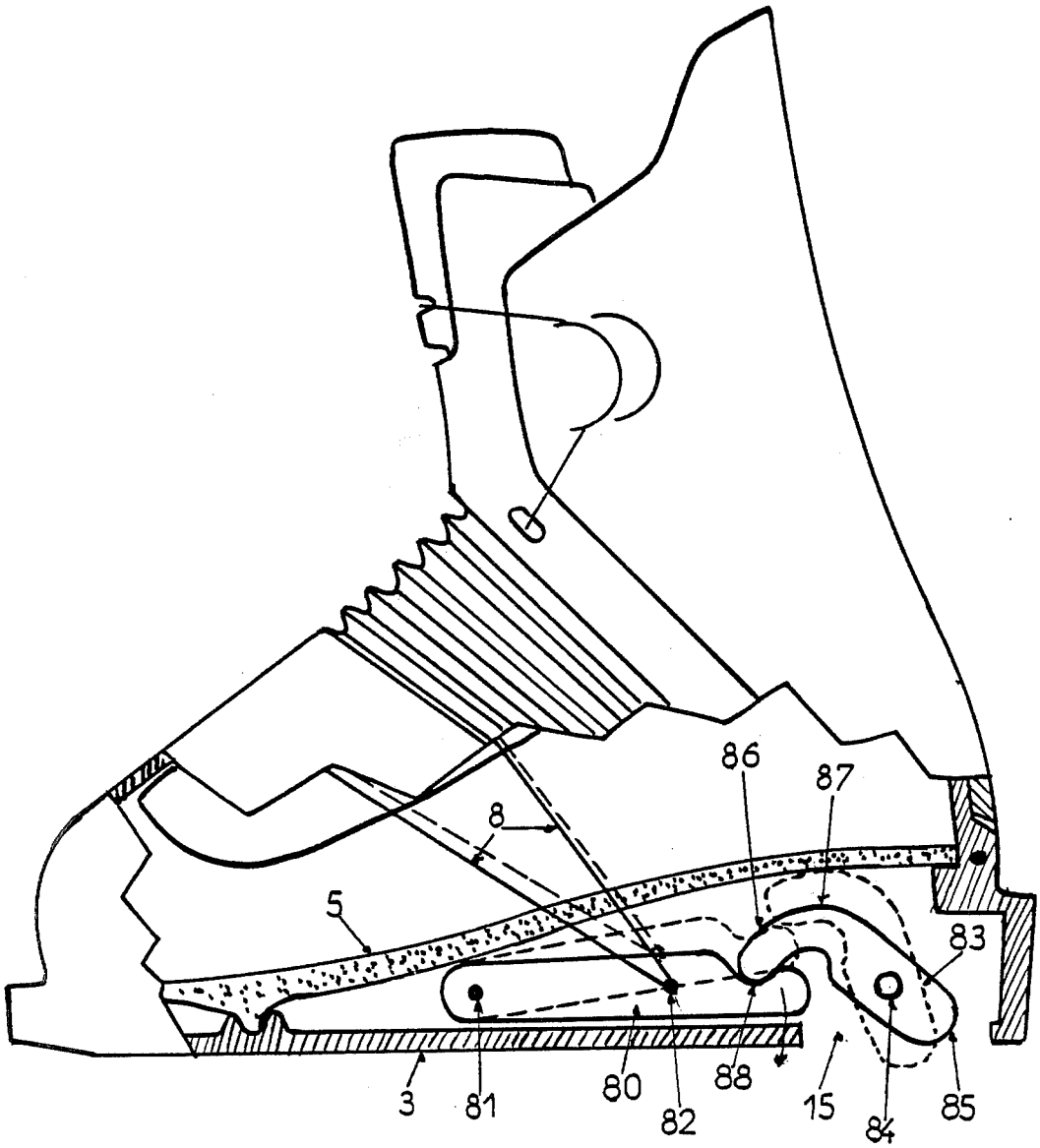

In the embodiment shown in FIG. 8, the tightening member is located in the space formed between the upper insole 5, and the sole 3, and comprises a rigid branch 80 directed toward the rear of the boot, articulated about a fixed horizontal axis 81 perpendicular to a vertical plane of the boot, the end of which includes another horizontal axis 82 parallel to axis 81, and located on both sides of the boot at the ends of the flexible tightening cables 8. Behind this branch is located a member formed with two branches 83, 87 whose height is shorter than that of the space between the sole 3 and the upper insole 5, also pivotally mounted about a fixed horizontal axis 84 parallel to 81. The lower end 85 of branch 83 is able to exit through hole 15 arranged for that purpose in sole 3, and whose upper curved end 86 of branch 87 applies pressure to the top 88 of the free end, that is pivotally to branch 80.

At rest, end 85 extends through hole 15 as shown in dotted lines. When put into place, this branch 83 pivots toward the top about axis 84 and end 86 bears strongly upon surface 88 causing branch 80 to pivot downward as indicated by the arrow. Under this action the cables 8 are tensioned.

In this embodiment the combined form of pieces 80 and 87 which are in contact makes possible a constant tension force on cables 8 in spite of the elastic length of the binding.

Figure 9:
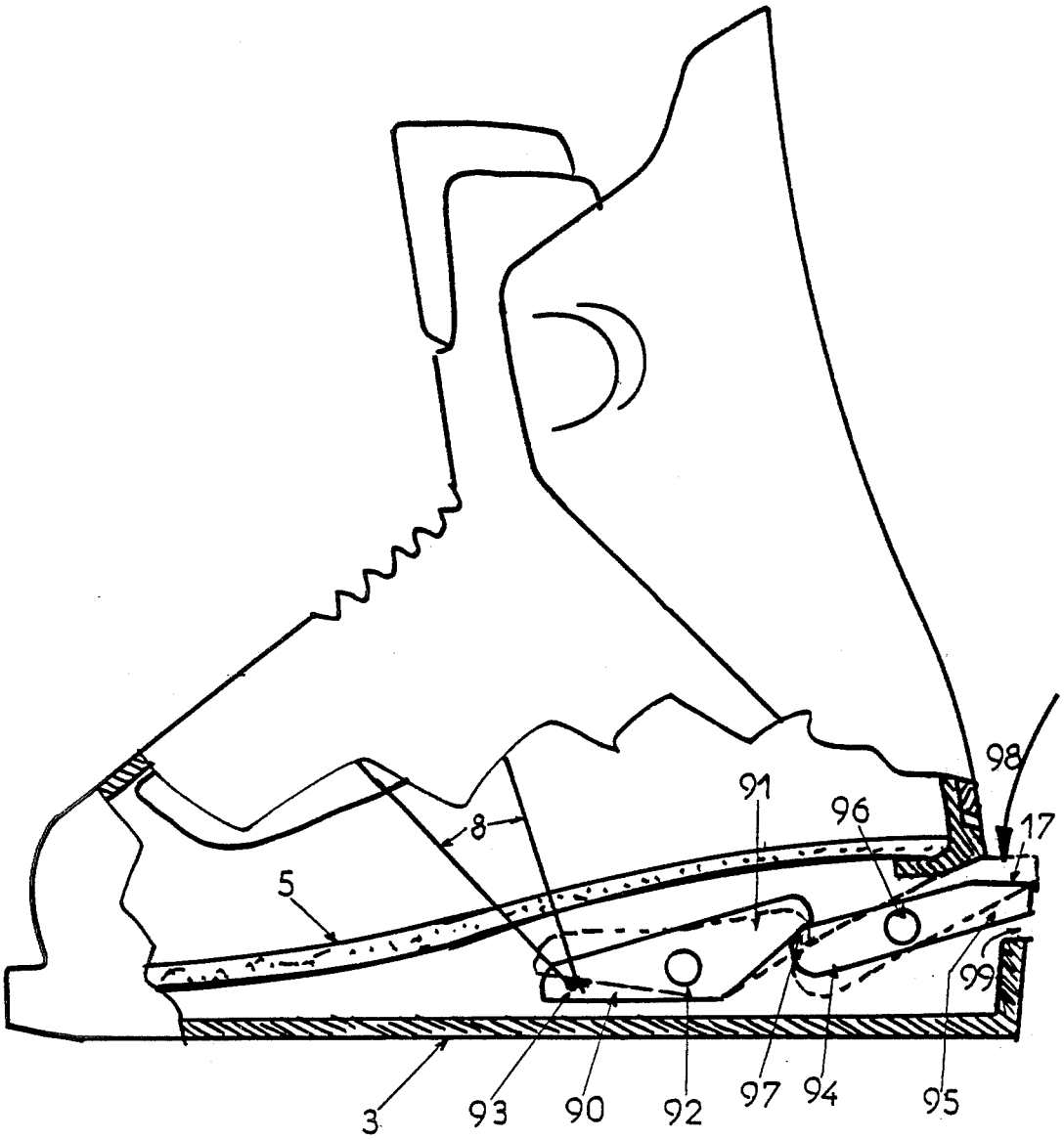

The arrangement represented in FIG. 9 comprises two pivoting members located between the upper insole 5 and the sole 3. A first member is located toward the front, formed of two aligned rigid, branches 90 and 91, capable of pivoting about fixed horizontal axis 92 which is perpendicular to the vertical plane of the boot and whose branch directed toward the front includes at its end a movable horizontal axis 93 to which are connected on both sides of the boot the ends of tightening cables 8. A second member is located to the rear, formed of two branches 94 and 95 also aligned, capable of pivoting about fixed horizontal axis 96 parallel to 92, of which the end of branch 94, directed toward the front, applies pressure to the lower surface 97 of branch 91, and whose other end 98 of branch 95, directed toward the rear, extends through a hole 99 arranged for this purpose in the pressure zone 17 of the jaw of the heel of the binding.

When one places the boot in place on the ski, the jaw 21 comes to bear upon end 98 in the sense indicated by the arrow, and pushes branch 95 downward. This branch 95, during the movement, pivots about axis 96 thus raising branch 94 whose upper end 95 then bears on the underside 97 of branch 91 thus causing pivoting thereof upward. During this pivoting movement about axis 92, branch 90 is displaced downward, thus assuring the tension on cables 8.

Figure 10:
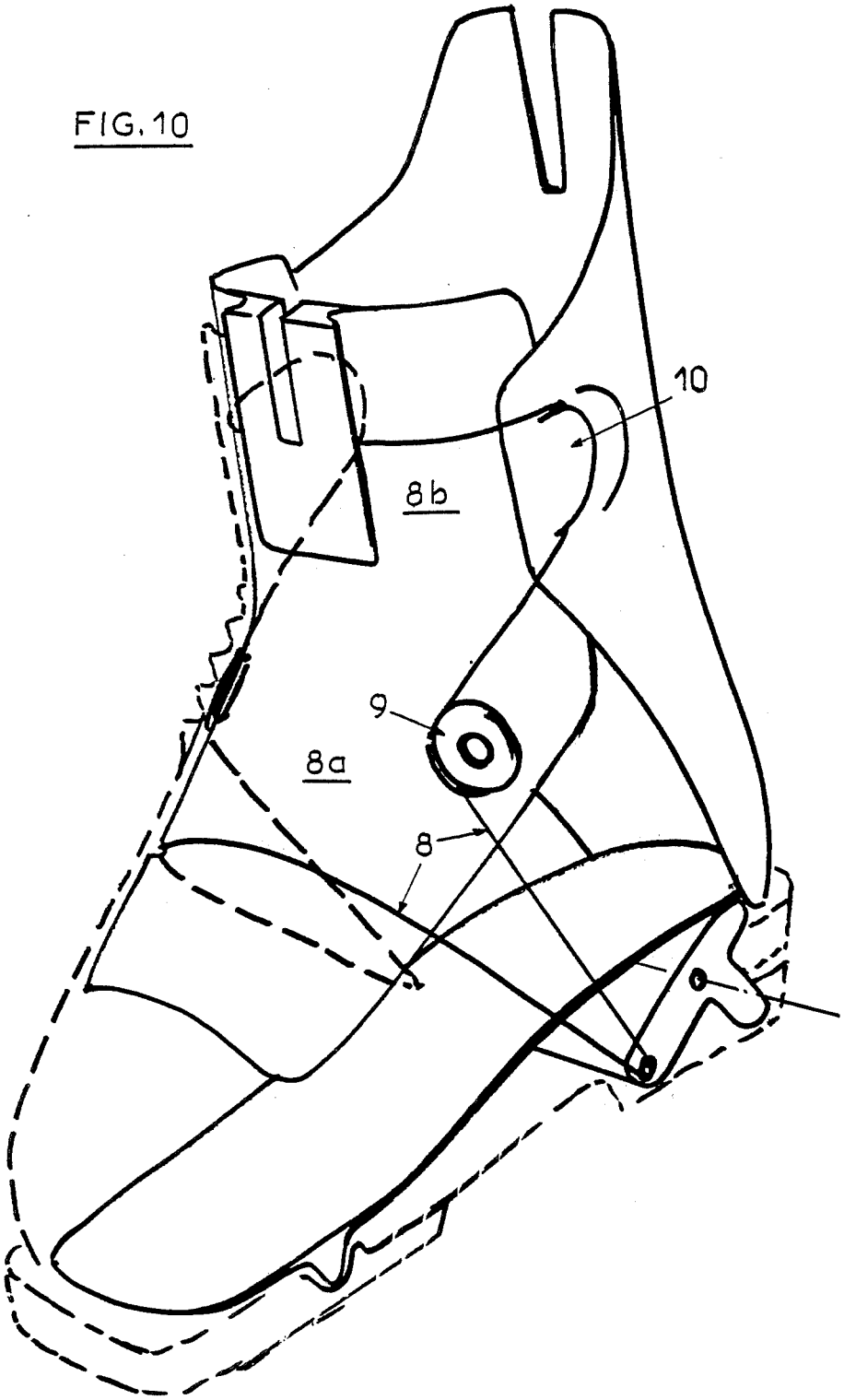
FIGS. 10 and 12 are perspective views summarizing a boot according to the invention.

FIG. 10 shows in perspective summary the essential pieces of a boot according to FIGS. 1 and 2. As can be seen, cables 8 are located on both sides of the boot tongue 8*a* and at the level of the ankle 8*b*, placing pressure on the swellings 9 and 10.

Figure 12:
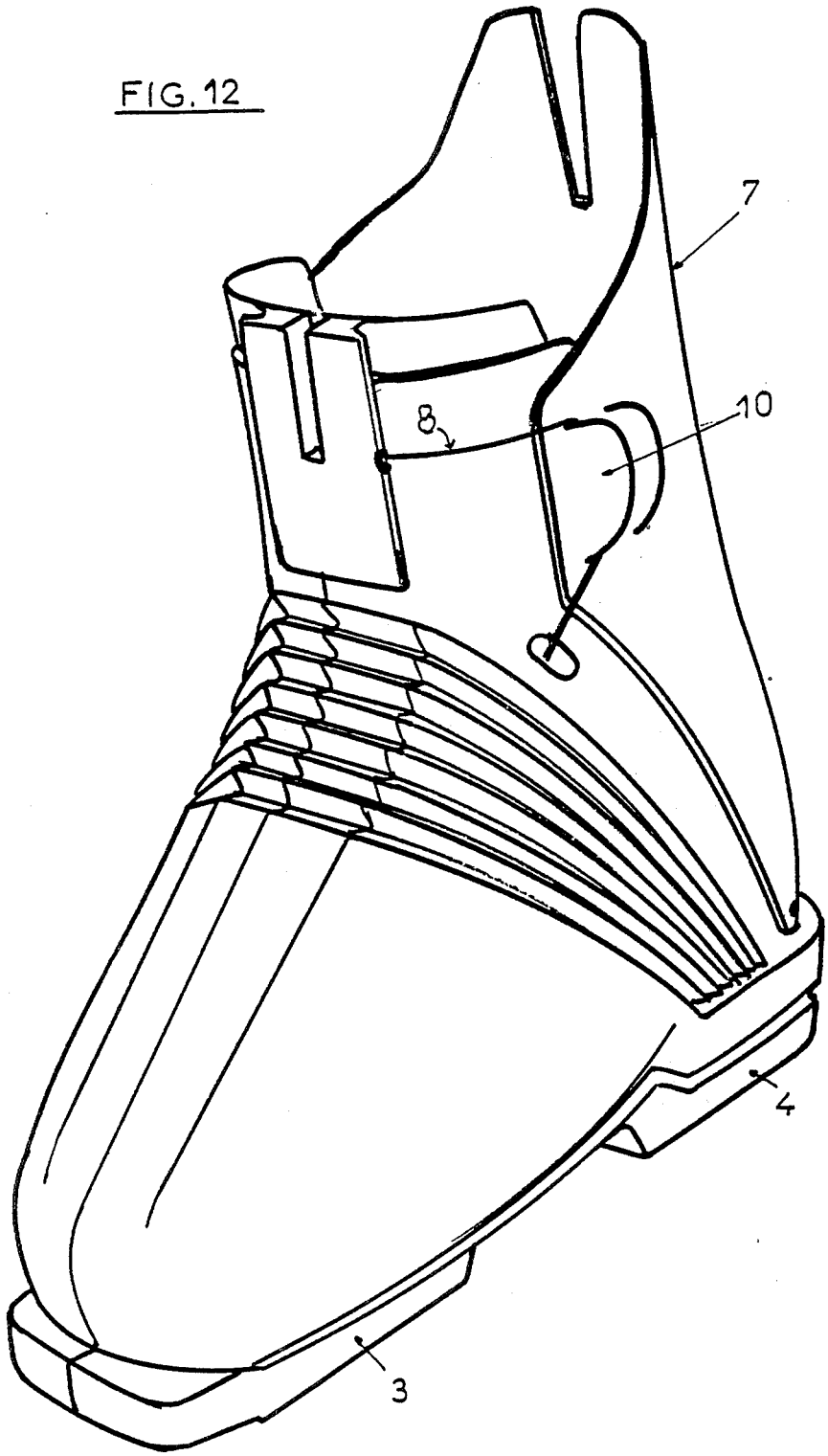

FIG. 12 shows in perspective an exterior view of a boot according to the invention.

Figure 11:
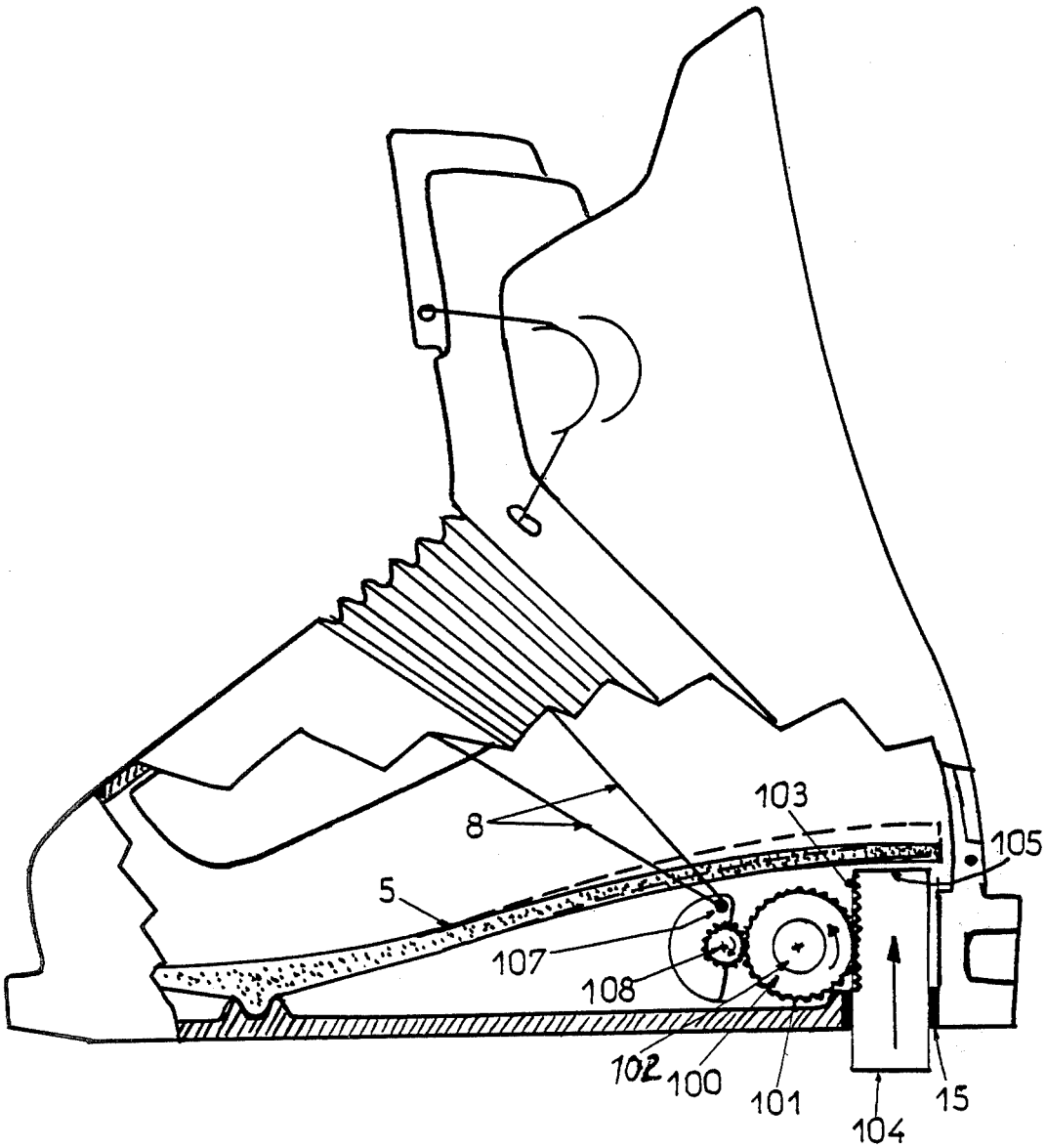

FIG. 11 shows another embodiment in which the rigid member comprises a toothed wheel 100 having teeth 101 and capable of rotating about a fixed horizontal axis 102 perpendicular to the longitudinal plane of the boot. The teeth 100 mesh with the teeth 103 located on one face of movable vertical piece 104 located to the rear of toothed wheel 100 and applying pressure toward the top 105 onto the lower face of upper insole 5 and whose lower part 106 extends through hole 15. The ends of cables 8 are fixed to wheels 107 (or similar elements) located laterally and movable about an axis 108.

When one places the boot in place, piece 104 rises to bear against upper insole 5. During this movement of displacement toward the top, the teeth 103 meshing with the teeth 102 of wheel 100 rotating in the sense indicated by the arrow, and thus turning wheel 107 assures the placing under tension of cables 8, and the resultant tightening.

In this way use is made of the locking forces given by the jaw of the heel binding to simultaneously and automatically tighten the foot in the boot, in a manner very much stronger and much more efficient than one is able to do by hand with the traditional levers or buckles.

In case of accidential release of the heel binding and/or of the toe binding, the end extending through the sole instantaneously descends and the tightening forces which maintain the boot in place and tightened onto the foot instantaeously diminish, so that the foot finds itself freed of all of the tightening forces.

In practice when skiing, a small amplitude of vertical displacement caused by the elastic length of the heel binding is translated to the foot by continuous variation of the tightening forces, which assists healthy circulation during the endeavor.

Figure 13:
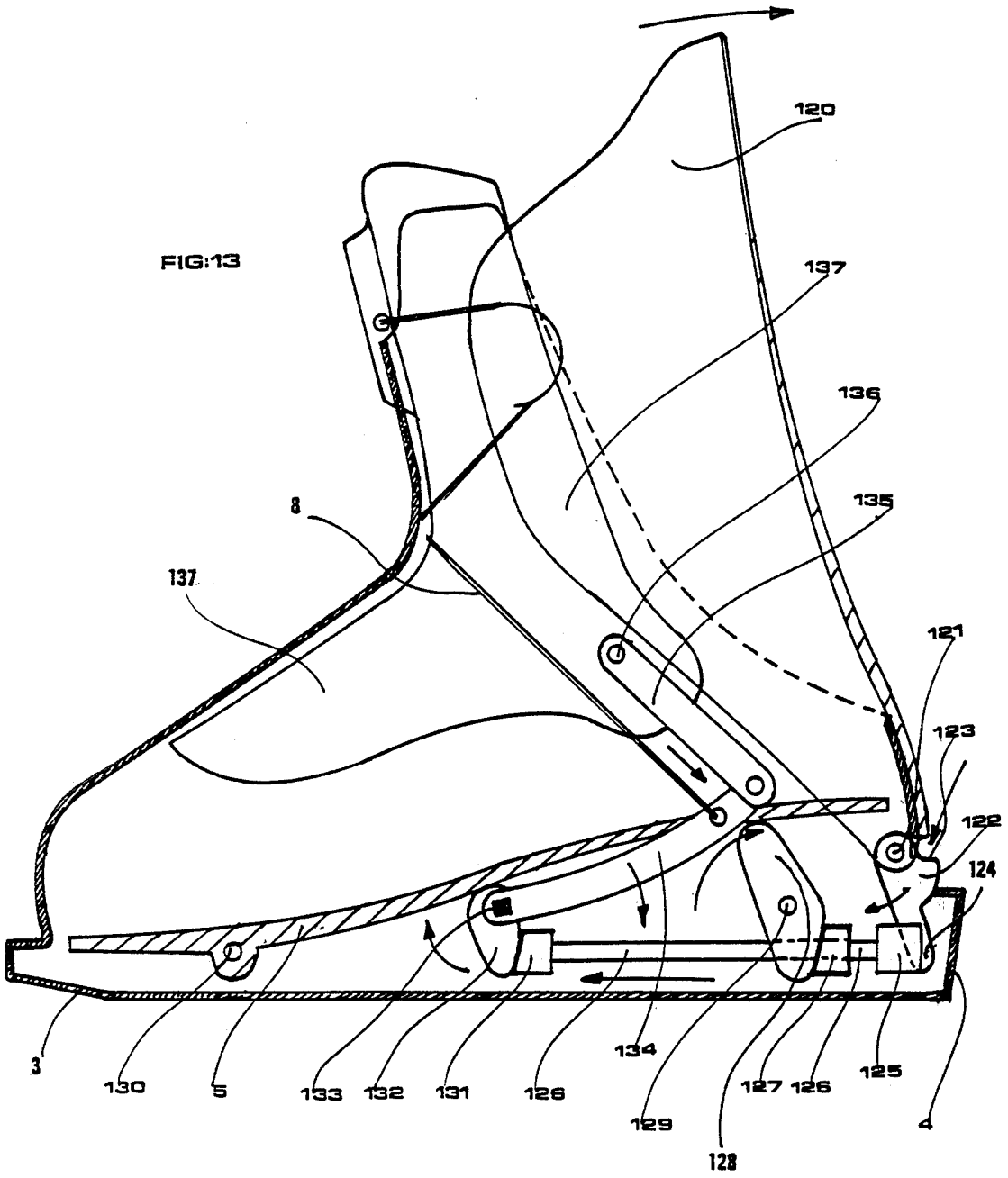
FIGS. 13 and 14 represent a preferred embodiment of a boot conforming to the invention, respectively showing a longitudinal section and a partial perspective view.
Figure 14:
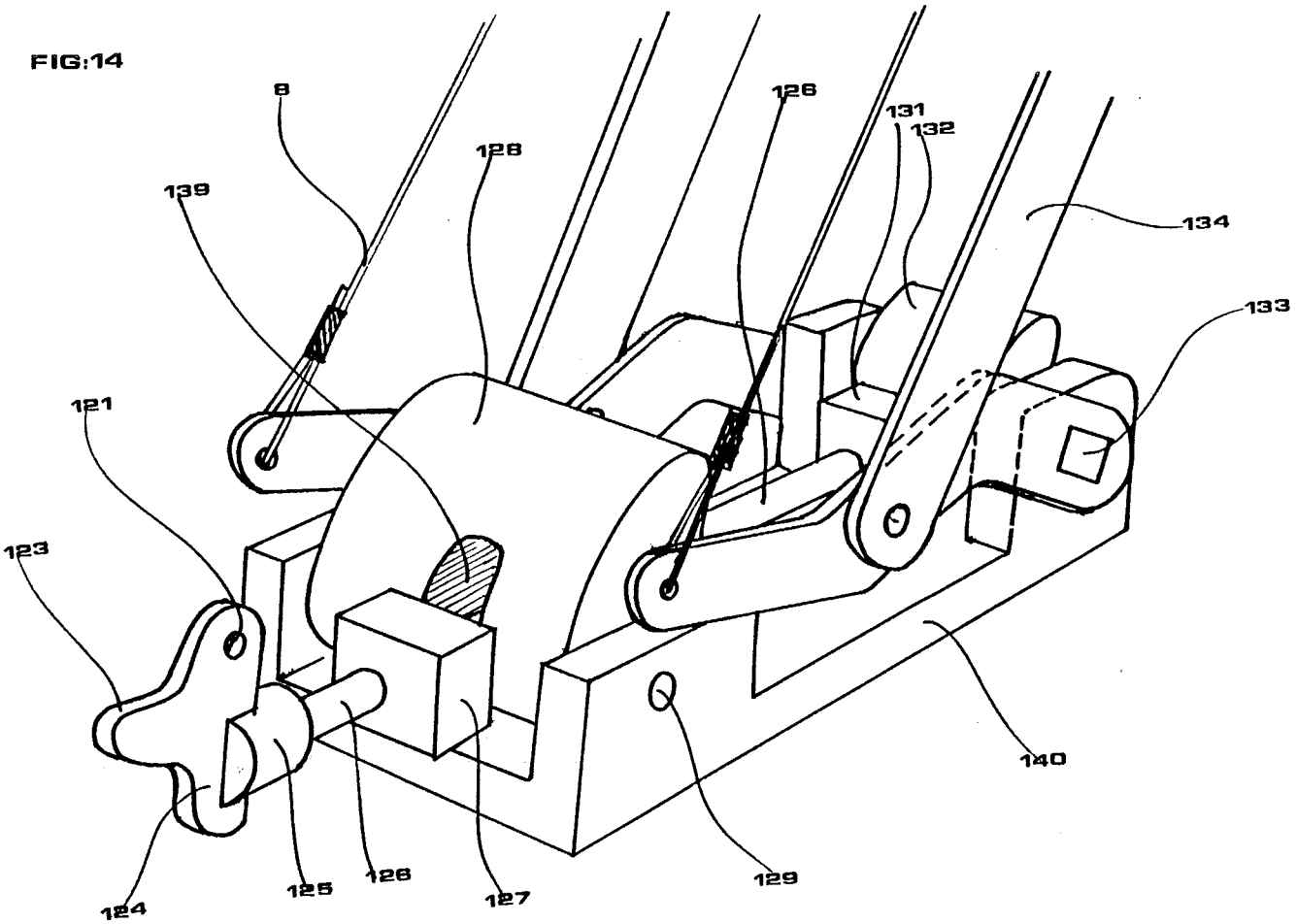

FIGS. 13 and 14 show, as already said, a preferred embodiment of a boot according to the invention. In this boot 120 represents the rear cover pivotally rotating about axis of rotation 121. 122 designates a rigid member pivoted about the same axis 121, located in the heel 4 between the rigid upper insole 5 and the sole 3; this member 122, for example of metal, is formed essentially of two branches 123 and 124. The first branch 123 extends from heel 4 in the manner such that the jaw of the heel binding is able to apply pressure to this branch. The second branch 124 is located between the upper insole 5 and the sole 3 in the heel 4. 125 designates a metallic pusher receiving pressure from the free face of branch 124, and whose other face is integral with a longitudinal metallic axis 126. As shown in FIG. 14, the pusher 125 is advantageously made in a manner to enclose branch 124 of pivoted member 122. On the longitudinal pushing axis 126, is placed another pusher 127 adjustable in position at the middle by a screw, not shown, and whose forward face applies pressure to a cam 128 pivoted about a horizontal axis 129. Advantageously, this cam 128 is of plastic material, polyamide, for example, and includes an opening 139 intended to permit free passage of the pushing axis 126 when in action as explained above. At the end of the pusher axis 126 there is placed another metallic pusher 131 whose front face bears upon a pivoted cam 132, for example also of plastic material, pivoted about an horizontal axis 133. The position of pusher 131 is also advantageously adjustable by screwing. This axis 133 is also advantageously polygonal (in the form of a rectangle or square) in this manner to entrain in its action a pivoted cam 134 which it is solidly attached. On the arm 134 the ends of the tightening cables 8 put pressure. At the end of arm 134 is placed a link 135, for example of steel, solidly attached to arm 134 whose end 136 is in turn solid with an interior form 137 in the form of a tongue of the boot. 130 designates a horizontal pivot axis crossing the boot upon which is applied the pressure of upper insole 5 which is connected to axis 130. 140 (see FIG. 14) designates a base, for example of plastic material, polyamide or other, intended to receive the completed assembly placed in the space between the upper insole 5 and the sole 3.

When one places the boot in place, the jaw of the heel piece of the binding presses on branch 123 of the pivoted member 122 (see the sense indicated by the arrows in FIG. 13). Branch 124 is displaced toward the front thus pushing the pushers 125 and 127 and thus causing cam 128 to pivot upward and thus causing descending of the rigid upper insole 5. At the same time, the cam 132 pivots toward the front and its pivoting movement pushes arm 134 rearward and downward. This movement of cam 132 and consequently of arm 134 simultaneously provokes the close contact between the foot of the skier and the interior form 137, thus assuring tightness, and, the tension of cables 8, which assure closing of the ensemble, and particularly the rear cover 120.

Such a boot provides numerous advantages for the skier. First, the operations of putting on and talking off the boot proceed automatically without manual intervention. The permanent elasticity of the tightening forces avoids cramps during skiing, improves healthy circulation and thus considerably increases the comfort of the skier. Finally, the moment of inertia at the time of a fall is substantially reduced, considerably improving the safety.

In addition, for the manufacturer, this solution advantageously permits omission of buckles or other similar closing systems, which are generally costly. This is translated into an appreciable economy in mounting and permits automatic fabrication of the boots. Otherwise, since the molded shell does not participate at all in the tightening operations, it is possible advantageously to decrease the thickness of the shell, which is translated into an appreciable gain of material.

It is evident that the pressure piece on the ski is able to be associated in a permanent arrangement, a precise adjustment of its position finally eliminating the functional actions of both the heel binding and the adjustment arrangement. Thus, for example, when the pressure piece is sensibly included in the form of a piston, the lower part thereof is able to comprise a permanent screw for varying its length. In addition, to obtain a working position, the assembly according to the invention is evidently associated with a permanent arrangement whose stop, for example at the middle of a transversely movable key coming to block the rigid element which places pressure on the ski.

What is claimed is:

1. A plastic ski boot, comprising:

a molded shell formed of a solid stock with the sole and a rigid upper insole for firmly tightening the shell onto the foot of a skier, wherein there is present at the level of the heel in the interior of the space formed between the upper insole and the sole, a rigid member connected at the end of means for tightening the boot which, when submitted to a pressure exerted on the ear of the boot by the locking of the rear stop of a ski binding onto the boot, exerts upon said tightening means a force for ensuring that the foot is held within the boot.

2. A ski boot according to claim 1 wherein the rigid member is pivotally mounted about an horizontal axis perpendicular to a longitudinal plane of the boot, and the ends of flexible tightening means are fixed to the rigid member near the end of the pivoting portion thereof.

3. A ski boot according to claim 2 wherein the pivoted rigid member comprises two branches directed toward the bottom of the sole, whose fixed horizontal pivot axis is located at the junction point of the two branches, and whose branch directed toward the front of the boot is connected to the end of the flexible tightening means.

4. A ski boot according to claim 3 wherein the sole includes an opening located at the level of the heel, through which passes the free end of the branch of the pivoted member directed to the rear of the boot, at least when the pivoted rigid member is at rest, that is when the flexible tightening means are not tensioned.

5. A ski boot according to claim 4 wherein the pivoted rigid member includes a third branch directed toward the rear of the boot and toward the underside of the upper insole, which third branch is substantially an extension of the branch directed toward the front of the boot, the upper face of this third branch located for receiving pressure from the lower face of the upper insole at the time of pivoting movement of the rigid member.

6. A ski boot according to claim 2 wherein there is another movable piece also located in the space between the upper insole and the sole, behind the pivoted rigid member and whose height is less than that of said space, said movable piece being slidable vertically in a hole arranged for that purpose in the heel of the sole, which piece applies pressure upward to the lower face of the upper insole.

7. A ski boot according to claim 6 wherein the free end of the branch of the pivoted rigid member directed toward the rear and the bottom of the sole is engaged in a hole made for that purpose in said sliding movable piece.

8. A ski boot according to claim 2 additionally comprising another movable piece also located in the space between the upper insole and the sole, behind the pivoted rigid member and whose height is less than that of said space, said movable piece for sliding vertically in a hole arranged for that purpose in the heel of the sole, and applying pressure upward to the free end of the branch of the pivoted rigid member directed toward the rear of the boot.

9. A ski boot according to claim 4, additionally comprising an eccentric wedge located at the rear of the boot just under the upper insole and the rear of the pivoted rigid member, the axis of articulation of said wedge being parallel to the axis of rotation of the pivoted rigid member, the face of the branch of the pivoted organ located opposite this wedge forming a cam for enabling said wedge to push the upper insole upward during pivoting of the rigid member.

10. A ski boot according to claim 3, additionally comprising a second pivoted rigid member also located between the upper insole and the sole behind the first pivoted rigid member, formed with two branches and whose pivot axis is parallel to that of the first pivoted rigid member, one of the ends of the branch of the second member located toward the rear and extending to the top rear of the sole for accepting pressure applied by a jaw of a heel binding, so that the end of the other branch of the second member bears against the underside of the branch of the first pivoted member directed toward the rear.

11. A ski boot according to claim 2, wherein the pivoted end of the rigid member which receives the end of the flexible tightening means is directed toward the rear of the boot with respect to the pivot axis, and the boot includes a second pivoted rigid member also located between the upper insole and the sole, behind the first pivoted member, formed with two branches articulated about an axis parallel to that of the first member and whose one branch is directed towards the rear of the boot and downward, while the other branch is directed toward the front of the boot and upward, in the form of a curve, so that its end comes to place pressure on the upper face of the pivoting end of the first movable member.

12. A ski boot according to claim 1, wherein the rear part of the shell may be opened toward the rear for introducing a foot of a skier.

13. A ski boot according to claim 1, wherein the flexible tightening means comprise metallic cables or plastic fibers.

14. A ski boot according to claim 1, wherein it includes within the space between the upper insole and the sole:

a rigid member located in the region of the heel, for pivoting about an horizontal axis perpendiclar to a longitudinal plane of the boot, located in the heel at the interior of the boot said rigid member being in the form of two branches, the first branch for extending through a hole located in the boot at the level of the heel, the second branch being situated in the space defined between the upper insole and the sole, the face in front of this second branch pressured under a pushing axis located in said space formed between the upper insole and the sole in the longitudinal direction of the boot, said pushing axis including: on its length an intermediate pusher applying pressure to a pivoted cam, about an horizontal axis perpendicular to a longitudinal plane of the boot, said cam for levering the rigid upper insole upward, and the end of the pushing axis another pivoted cam also about an horizontal axis, solidly connected to an arm at the end of the flexible tightening means.

* * * * *